US008184004B2

(12) United States Patent
Roosli

(10) Patent No.: US 8,184,004 B2
(45) Date of Patent: May 22, 2012

(54) SYSTEM TO DETECT PRESENCE IN A SPACE

(75) Inventor: Philipp Roosli, Niantic, CT (US)

(73) Assignee: Inncom International Inc., Niantic, CT (US)

( * ) Notice: Subject to any disclaimer, the term of this patent is extended or adjusted under 35 U.S.C. 154(b) by 613 days.

(21) Appl. No.: 12/361,579

(22) Filed: Jan. 29, 2009

(65) Prior Publication Data

US 2010/0188218 A1 Jul. 29, 2010

(51) Int. Cl.
*G08B 13/08* (2006.01)

(52) U.S. Cl. ..... 340/545.1; 340/545.2; 340/541; 340/545.5

(58) Field of Classification Search ..... 340/545.1
See application file for complete search history.

(56) References Cited

U.S. PATENT DOCUMENTS

| | | | | | |
|---|---|---|---|---|---|
| RE33,146 | E | * | 1/1990 | Carrell et al. | 165/11.1 |
| 5,476,221 | A | * | 12/1995 | Seymour | 236/47 |
| 5,489,827 | A | * | 2/1996 | Xia | 315/294 |
| 5,538,181 | A | * | 7/1996 | Simmons et al. | 236/51 |
| 5,586,048 | A | * | 12/1996 | Coveley | 702/189 |
| 5,640,143 | A | * | 6/1997 | Myron et al. | 340/541 |
| 5,861,806 | A | * | 1/1999 | Vories et al. | 340/555 |
| 5,933,085 | A | * | 8/1999 | Holcomb et al. | 340/5.66 |
| 6,788,202 | B2 | * | 9/2004 | Holmes et al. | 340/541 |
| 7,498,936 | B2 | * | 3/2009 | Maeng | 340/539.1 |

* cited by examiner

*Primary Examiner* — George Bugg
*Assistant Examiner* — Kerri McNally
(74) *Attorney, Agent, or Firm* — Cantor Colburn LLP

(57) ABSTRACT

A system to detect a presence in a space is provided and includes a sensor to issue a signal at an instance when a door to the space closes, a detector to periodically issue packets that identify when a presence was last detected in the space, and a processing unit, coupled to the sensor and the detector, which is configured to receive the signal and the packets and which has executable instructions stored thereon that, when executed, cause the processing unit to identify when the door closes based on the signal and to judge the space to be unoccupied after a wait time if the packets indicate the presence was last detected prior to the closing.

19 Claims, 3 Drawing Sheets

SYSTEM TO DETECT PRESENCE IN A SPACE

BACKGROUND OF THE INVENTION

The subject matter disclosed herein relates to occupancy detectors and, more particularly, occupancy detectors with managed communication traffic, reduced power consumption and improved occupancy determination.

Occupancy detectors, such as motion detectors, have been used for occupancy detection in many industries, such as the security and hospitality industries, for many years. In the hospitality industry, energy management systems have used motion detectors in the control of temperature setbacks or automatic lighting as a function of a presence determination of a person.

In hotel guestrooms, occupancy detection provided by motion detectors is also often augmented with a system that senses when a door to the room opens and closes. This is useful in applications where a person will not create any motion for a prolonged period of time, such as when sleeping in a bed or when visiting the bathroom and not being visible to the motion detector. In such cases, the system recognizes that the room door has closed recently but does not simply declare the room as being unoccupied just because no current motion is detected.

In these systems, when a door closure is sensed, the augmented occupancy detection system allows for a certain amount of time to pass (i.e., ten minutes) in which the room is assumed by the system to be occupied. Should motion be detected in that period of time, the system assumes that the room is occupied. If, after expiration of the period of time, no motion is detected, the room will be declared as being unoccupied. Afterwards, a guestroom control system can start to conserve energy in the room by setting back the temperature control, turning off lamps or by just informing the hotel staff at a management console that the room is no longer occupied. The room will now stay unoccupied at least until the next door opening or closing event has been detected. Once such an event is detected and the room is declared to be occupied, the system again waits for the door closure event and thereafter again attempts to declare the room as being unoccupied. However, in a case in which the room is declared unoccupied but a later motion signal is detected without a prior door opening, the system needs to recognize that the room was mistakenly declared unoccupied and subsequently declare the room as being occupied. In such a case, energy conservation methods are reversed and restored back to normal.

Typically, in the hospitality industry, motion detectors are wired to a controller that provides power to the motion detecting components, receives the motion signals, processes the door opening and closing events and determines the occupancy state of the room in a fashion similar to that which is described above. In addition, motion detectors are generally connected to a network to which the motion signals are sent as data packets at certain time intervals, which can be rather long to conserve power.

When such a controller senses a door closure event, the controller begins looking for occupancy signals. However, if the motion detector reports in a subsequent packet that there was motion detected but the detected motion actually occurred before the door closed, the motion detector may send the packet to the network as indicating that the room is occupied when it might not be.

BRIEF DESCRIPTION OF THE INVENTION

According to one aspect of the invention, a system to detect a presence in a space is provided and includes a sensor to issue a signal at an instance when a door to the space closes, a detector to periodically issue packets that identify when a presence was last detected in the space, and a processing unit, coupled to the sensor and the detector, which is configured to receive the signal and the packets and which has executable instructions stored thereon that, when executed, cause the processing unit to identify when the door closes based on the signal and to judge the space to be unoccupied after a wait time if the packets indicate the presence was last detected prior to the closing.

According to another aspect of the invention, a system to detect a presence in a hotel guestroom is provided and includes a sensor to issue a signal at an instance when a door to the guestroom closes, a detector to periodically issue packets that identify when a presence was last detected in the guestroom, and a processing unit, coupled to the sensor and the detector, which is configured to receive the signal and the packets and which has instructions stored thereon that, when executed, cause the processing unit to identify when the door closes based on the signal and to judge the guestroom to be unoccupied after a wait time if the packets indicate the presence was last detected prior to the closing.

According to yet another aspect of the invention, a method of operating a presence detection system is provided and includes, following an indication that a door providing entry to a space closes, monitoring the space for an indication of a presence therein, judging that the space is occupied if the monitoring indicates the presence in the space, and, after a wait time, judging that the space is unoccupied if the monitoring indicates the presence in the space last occurred prior to the door closure.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
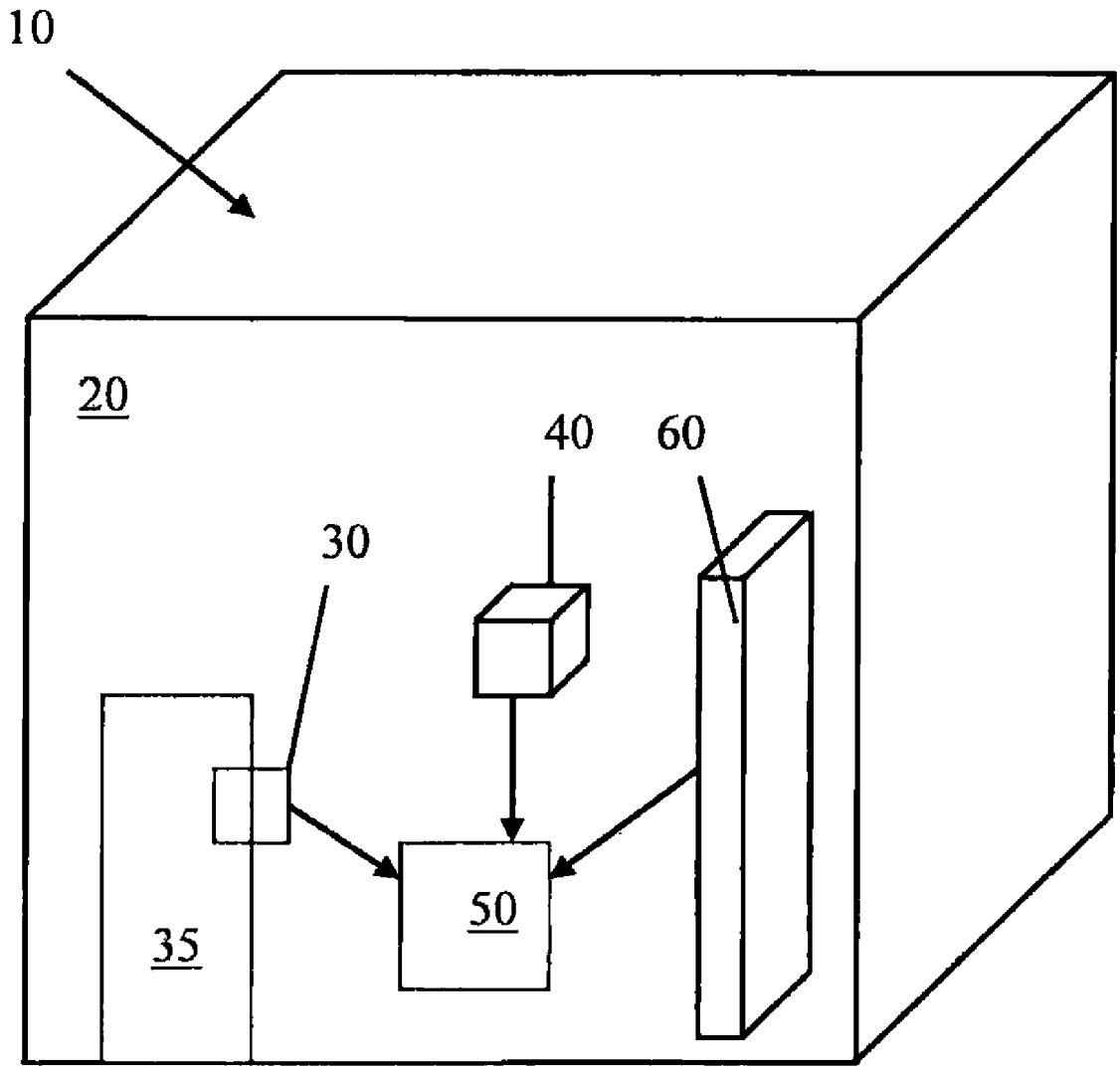
FIG. 1 is a perspective view of a space in which an exemplary presence detection system is disposed according to embodiments of the invention.
Figure 2:
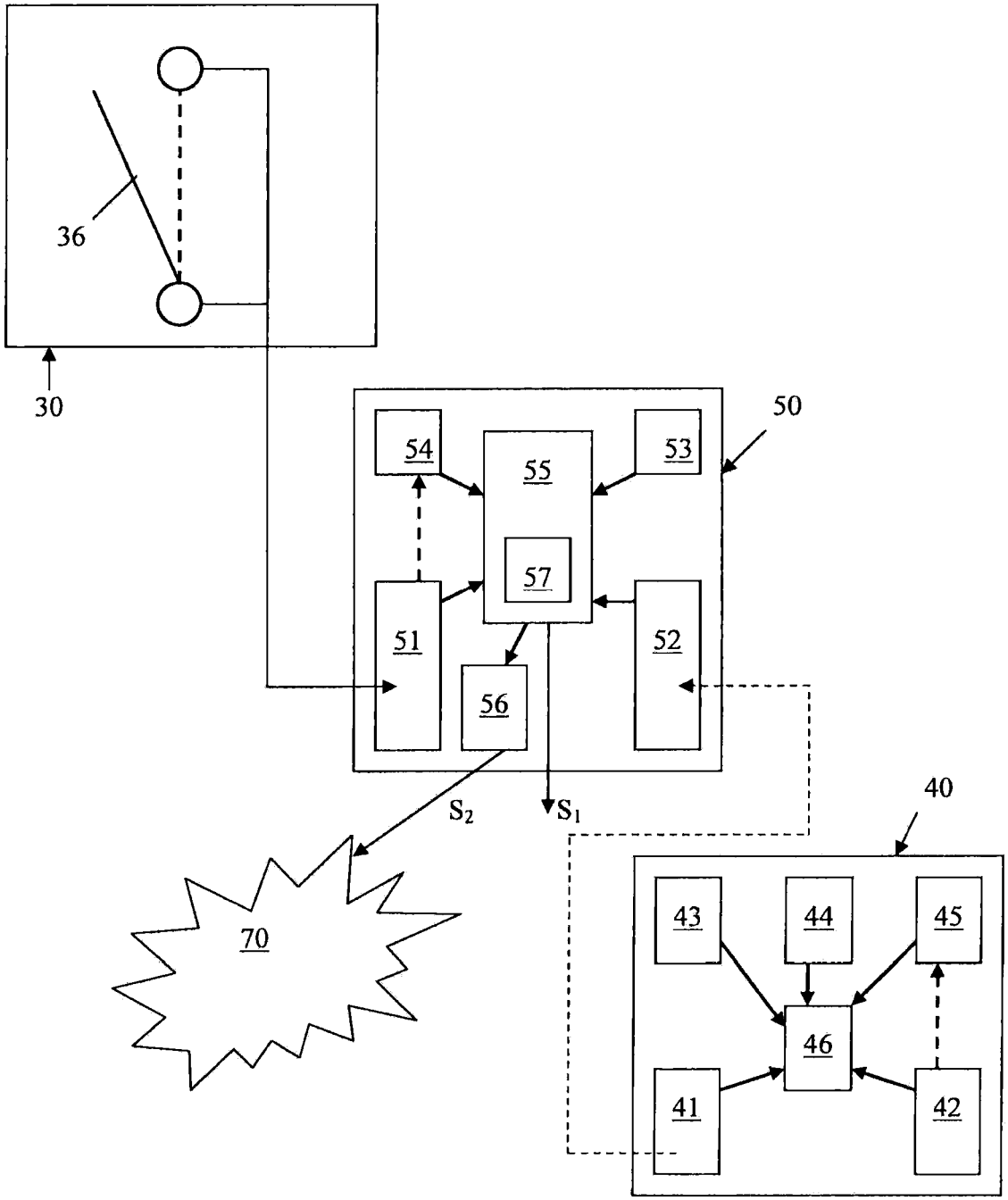
FIG. 2 is a schematic diagram of the presence detection system of FIG. 1.
Figure 3:
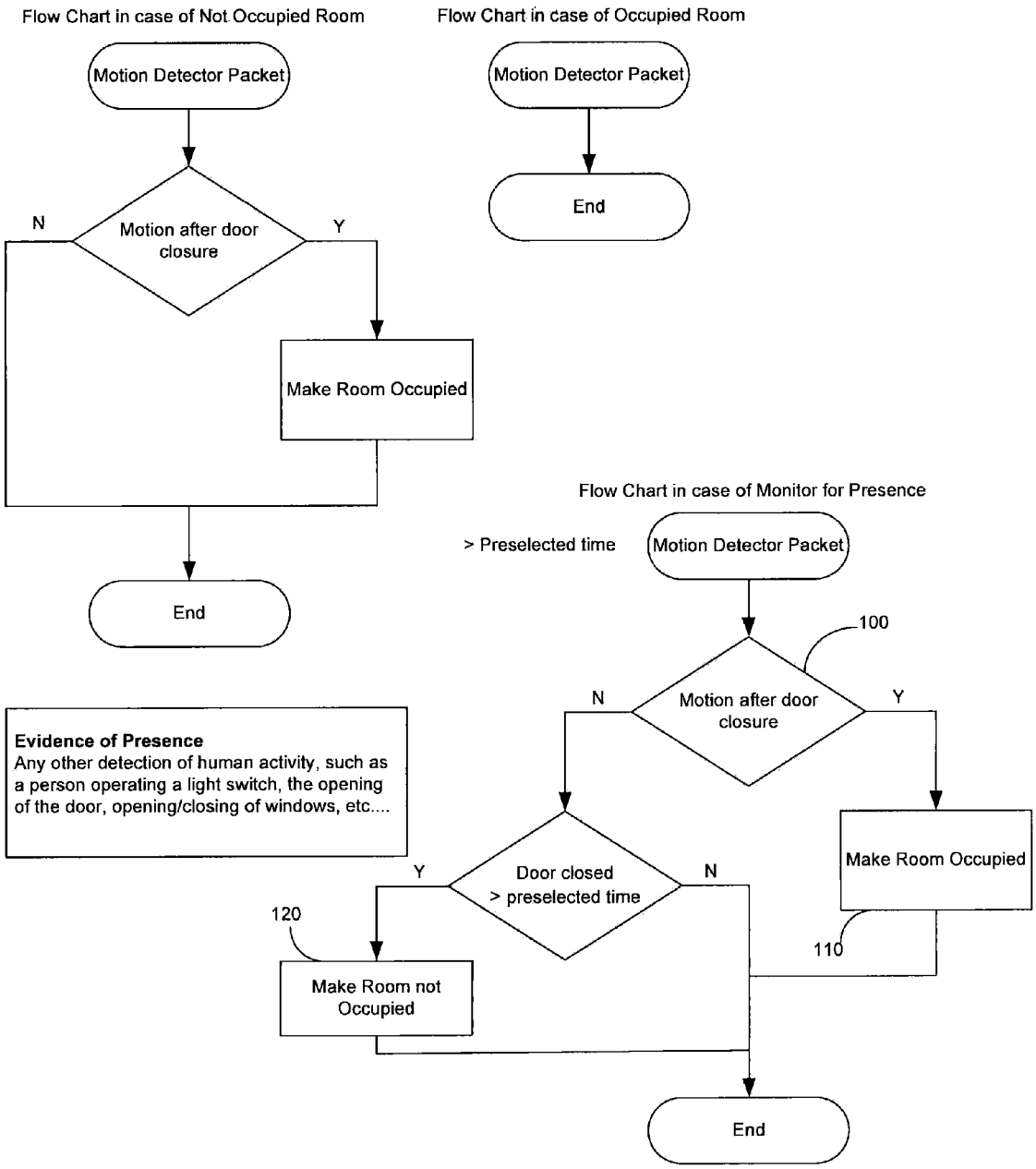
FIG. 3 is a flow diagram illustrating an operation of the presence detection system of FIG. 1.

With reference to FIGS. 1-3, a system 10 to detect a presence in a space 20, such as a hotel guestroom, is provided. In accordance with embodiments of the invention, the system 10 includes a sensor 30 to issue a signal at an instance when a door 35, which provides entry to the space 20, closes. A detector 40, such as a passive infrared (PIR) motion detector or a sound detector, periodically transmits packets that identify when a presence, such as that of a person in the space 20, was last detected in the space 20. A processing unit 50 is coupled to the sensor 30 and the detector 40 and is configured to receive the signal and the packets. The processing unit 50 thereby identifies when the door 35 closes based on the received signal from the sensor 30 and subsequently judges the space 20 to be occupied or unoccupied based on the received signal and information contained in the packets that describes when the presence was detected in the space 20. That is, the processing unit 50 judges the space 20 to be occupied by default and judges the space 20 to be unoccupied only if, after a wait time (e.g., about 10 minutes following the closing of the door 35) has elapsed, the packets indicate the presence in the space 20 was last detected prior to the closing of the door 35.

Generally, the packets will be transmitted at intervals of at least half the length of the wait time. Thus, if the wait time is 10 minutes, the detector 40 may be configured to transmit the packets every 5 minutes or less and, if the presence in the space 20 is detected in the interval between packet transmissions, the subsequent packets will indicate the time of the presence detection. The processing unit 50, having received the signal from the sensor 30 and the subsequent packets, can then compare the time of the presence detection with the time of the door 35 closure and determine which event happened later. If the presence detection is found to have occurred before the door closure 35 and the wait time has expired, the processing unit 50 determines that the occupant of the space 20 has left the space 20 unoccupied. The unoccupied judgment then remains in effect until a preselected event (i.e., the subsequent opening or closing of the door 35) occurs. On the other hand, if the presence detection happened after the door 35 closure, the processing unit 50 determines that the occupant closed the door 35 without leaving the space 20 and that the space 20 is therefore occupied. Conversely, if the wait time has not expired, the processing unit 50 determines that the space cannot be judged to be unoccupied for risk of a false negative result.

With this configuration, the frequency of packet transmissions from the detector 40 is limited and, as such, since packet transmissions require a relatively large power level, the demand for power by the detector 40 is reduced. Nevertheless, in spite of the limited number of packet transmissions, the information as to when the presence is detected in the space 20, which is contained within the packets, provides an accurate description of the occupancy state of the space 20.

As shown in FIG. 2, the sensor 30 may include a door sensor that senses when the door 35 opens and closes. The sensor 30 may include a spring loaded plunger, disposed within the door frame, which is depressed when the door is closed and extended when the door is ajar, or some other suitable mechanical, electro-mechanical or optical device. The sensor 30 could further include a switch 36 through which current passes when the switch is closed along with the door 35. As such, with the sensor 30 coupled to the processing unit 50, such that the processing unit 50 determines whether current passes through the switch 36, a lack of current followed by current passing through the switch 36 could be interpreted by the processing unit 50 as the signal that the door 35 closes. Of course, it is understood that this configuration is merely exemplary and that other devices and arrangements thereof are possible.

The detector 40 may be a motion detector or a sound detector that, in any case, detects the presence of a person or some other preselected entity within the space 20. Where the detector 40 is a motion detector, the detector 40 may include a passive infrared (PIR) motion detector, an active motion detector or some other suitable motion detector.

As shown in FIG. 2, and in accordance with an embodiment of the invention, the detector 40 may include a transmitter 41, a detecting device 42, a power source 43, first and second timers 44 and 45 and a processor 46. The transmitter 41 periodically transmits the packets, which may be data packets, to the processing unit 50. The detecting device 42 may include a lens, through which infrared radiation indicative of a presence within the space 20 propagates, and a solid state sensor that is charged by the radiation such that a presence signal can be issued from the detecting device 42 in accordance with the charge. The power source 43 may be a battery or some other suitable device that provides power to the detector 40. The processor 46 is coupled to the transmitter 41, the detecting device 42, the power source 43 and the first and second timers 44 and 45 and thereby controls the operation of each in accordance with executable instructions stored thereon.

The first timer 44 is coupled to the processor 46 and identifies when the packets are to be transmitted from the transmitter 41 and may include a clock or some other resetting timer. As noted above, in some embodiments of the invention, the packets are to be periodically transmitted from the transmitter 41 at an interval of less than half the length of the wait time. That is, if the processing unit 50 is configured to wait for 10 minutes following a door closure event before which the processing unit 50 cannot judge the space 20 to be unoccupied, the packet transmission interval is set to be 5 minutes or less.

The second timer 45 is coupled to the processor 46 and, in some cases to the detecting device 42, and identifies a time when presence detection occurs within the space 20. In this way, the first timer 44 may include a clock or some other resetting timer, which is reset each time presence detection occurs, that is queried by the processor 46 or the detecting device 42 whenever the detecting device 42 indicates that presence detection occurs. The second timer 45 then responds to the query by sending time stamp data, which is indicative of the time of the presence detection and which can be added to the next packet transmission to the processor 46.

Thus, in an example in which the packet transmission interval is 5 minutes with the last packet being transmitted at 11:59 AM, if the presence in the space 20 is detected at 12:02 PM as a result of, e.g., motion in the space 20 at that time, the packet transmitted at 12:04 PM will indicate that the last presence detection occurred at 12:02 PM. In this way, the packet transmission interval is not required to be decreased, with an associated power demand increase, in order to accurately convey a description of presence within the space 20 to the processing unit 50. In an alternate embodiment, the transmission at 12:04 PM could indicate that the last motion occurred 2 minutes ago in relation to the current transmission and the receiving device could then compute the absolute time based on a clock in the receiving device.

The detector 40 and the processing unit 50 may communicate with one another by way of various communications schemes that may, in some cases, include wired or wireless networks.

As shown in FIG. 2, the processing unit 50 includes first and second input units 51 and 52, a power source 53, a third timer 54, a processor 55 and an optional networking unit 56. The first and second input units 51 and 52 are configured to receive the signal from the sensor 30 and the packets from the detector 40, respectively. The power source 53 provides power to the processing unit 50 and may include a battery or a connection to an external power network, such as that of a hotel or office building. The third timer 54 operates in a similar fashion to the second timer 45 in that the third timer 54 time stamps the signal received by the first input unit 51 such that the processor 55 can determine when the initiating door closure event occurred.

The processor 55 is coupled to the first and second input units 51 and 52, the power source 53 and the third timer 54 and further includes a memory unit 57 having instructions stored thereon that, when executed, cause the processor 55 to operate as described herein. The memory unit 57 may itself include random access memory (RAM) units, read-only memory (ROM) units and/or any other suitable storage systems. With this configuration, the processor 55 is further configured to output occupied and unoccupied signals, via signal $S_1$, in accordance with judgments that the space 20 is or is not occupied, respectively.

The processing unit 50, as a whole, may be a stand-alone device or, alternately, may be integrated into any one of several devices normally present within the space 20, such as, where the space 20 is, e.g., a hotel guestroom, a thermostat. Here, the occupied and unoccupied signals may be used to set environment conditions within the space 20. For example, when the space 20 is judged to be unoccupied, an energy conservation mode in the space 20 may be engaged in order to conserve power. That is, if the space 20 is a guestroom of a hotel and the guest leaves the room with the local air conditioning unit running at high speed, the unoccupied signal may be used to determine that it will not cause the guest inconvenience if the air conditioning unit is slowed down or shut off completely to save power.

Such a shut off will generally only be undertaken when there is a clear indication that the space 20 is unoccupied. Thus, the processing unit 50 will, by default, judge the space 20 to be occupied and will only output the unoccupied signal if it can be determined that the packets are being properly received by the processing unit 50 with the packets indicating that no presence detection has occurred in the space 20 for at least the wait time.

The processing unit 50 may further include a networking unit 56 by which the processor communicates with an external network 70, such as a wireless or wired network of a hotel, by way of signal $S_2$. The networking unit 56 allows the processing unit 50 to inform the network 70 of current conditions within the space 20 and current operating conditions of the system 10. For example, if the processing unit does not receive the packets properly or the power levels of power sources 43 and 53 are low, the networking unit 56 allows the processing unit 50 to issue a request for service to the network 70.

With reference to FIG. 1 and in accordance with an additional embodiment, the system 10 may further include an additional device 60 within the space 20 that is coupled to the processing unit 50. The additional device 60 may be an appliance within the space 20 that is operated by someone present in the space 20 and which sends a presence signal to the processing unit 50 that serves as a backup to the packet transmissions in case receipt of the packet transmissions is impaired. As such, if the detector 40 malfunctions, the presence signal can be recognized by the processing unit 50 as being evidence of the presence within the space. That is, upon reception of the signal from the sensor 30 and the presence signal, the processing unit 50 identifies when the door 35 closes and, using a time stamp from the third timer 54, when the presence was last detected based on the signal and the presence signal. The processing unit 50 then judges the space 20 to be unoccupied after the wait time following the closing if the presence signal indicates the presence was last detected prior to the closing.

With reference to FIG. 3 and in accordance with another aspect of the invention, a method of operating a presence detection system is provided and includes following an indication that a door providing entry to a space closes, monitoring the space for an indication of a presence therein 100, judging that the space is occupied if the monitoring indicates the presence in the space 110, and, after a wait time following the door closure, judging that the space is unoccupied if the monitoring indicates the presence in the space last occurred prior to the door closure 120. In accordance with the method, the judging that the space is unoccupied remains in effect until a subsequent door opening event or a subsequent door closure. In either case, at this point, the method repeats. In addition, the method may further comprise judging that the space is occupied in an absence of an indication of the presence by default and, as mentioned above, affecting an environmental condition of the space when the space is judged to be unoccupied.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A system to detect a presence in a space, the system comprising:

A sensor to issue a signal at an instance when a door to the space closes;

a detector to periodically issue packets that identify when a presence was last detected in the space; and a processing unit, coupled to the sensor and the detector, which is configured to receive the signal and the packets and which has executable instructions stored thereon that, when executed, cause the processing unit to identify when the door closes based on the signal and to judge the space to be unoccupied after a wait time if the packets indicate the presence was last detected prior to the closing;

wherein the detector comprises a first timer to identify when the packets are to be issued and a second timer to identify when the presence was last detected.

2. The system according to claim 1, wherein the sensor comprises a door sensor that senses when the door opens and closes.

3. The system according to claim 1, wherein the space comprises a hotel guestroom.

4. The system according to claim 1, wherein the detector comprises a passive infrared (PIR) motion detector.

5. The system according to claim 1, wherein the second timer is reset when the presence is detected.

6. The system according to claim 1, wherein the detector and the processing unit communicate via a wireless network.

7. The system according to claim 1, wherein the processing unit comprises a third timer to identify when the door closes based on the signal.

8. The system according to claim 1, wherein a default state of the processing unit is to judge the space to be occupied.

9. The system according to claim 1, wherein the processing unit outputs occupied and unoccupied signals when the space is or is not judged to be occupied, respectively.

10. The system according to claim 9, wherein an energy conservation mode in the space is engaged when the unoccupied signal is output.

11. The system according to claim 1, wherein the processing unit communicates with a network.

12. The system according to claim 11, wherein the processing unit alerts the network when receipt of the packets is impaired.

13. The system according to claim 1, wherein the processing unit receives a presence signal indicative of the presence, and, upon reception of the signal and the presence signal, identifies when the door closes and when the presence was last detected based on the signal and the presence signal and judges the space to be unoccupied after the wait time if the presence signal indicates the presence was last detected prior to the closing.

14. The system according to claim 1, further comprising an environmental control system, in signal communication with the processing unit, which affects an environmental condition in the space when the space is unoccupied.

15. A system to detect a presence in a hotel guestroom, the system comprising:

a sensor to issue a signal at an instance when a door to the guestroom closes;

a detector to periodically issue packets that identify when a presence was last detected in the guestroom; and a processing unit, coupled to the sensor and the detector, which is configured to receive the signal and the packets and which has instructions stored thereon that, when executed, cause the processing unit to identify when the door closes based on the signal and to judge the guestroom to be unoccupied after a wait time if the packets indicate the presence was last detected prior to closing;

wherein the detector comprises a first timer to identify when the packets are to be issued and a second timer to identify when the presence was last detected.

16. A method of operating a presence detection system, comprising:

following an indication that a door providing entry to a space closes, monitoring the space for an indication of a presence therein via a detector including a detecting device;

periodically receiving packets issued by the detector at a processing unit coupled to the detector, the packets identifying when a presence was last detected in the space;

judging at the processing unit that the space is occupied if the monitoring indicates the presence in the space following closure of the door; and after a wait time following the closure of the door as determined by a timer included in the processing unit, judging at the processing unit that the space is unoccupied if the monitoring indicates the presence in the space last occurred prior to the door closure, wherein the detector comprises a first timer to identify when the packets are to be issued and a second timer to identify when the presence was last detected.

17. The method according to claim 16, wherein the judging that the space is unoccupied remains in effect until a subsequent door opening.

18. The method according to claim 16, further comprising judging that the space is occupied in an absence of an indication of the presence.

19. The method according to claim 16, further comprising affecting an environmental condition of the space when the space is unoccupied.

* * * * *